US010258984B2

(12) United States Patent
Verhoeckx et al.

(10) Patent No.: US 10,258,984 B2
(45) Date of Patent: Apr. 16, 2019

(54) CARTRIDGE FOR FAST SAMPLE INTAKE

(71) Applicant: KONINKLIJKE PHILIPS N.V., Eindhoven (NL)

(72) Inventors: Godefridus Johannes Verhoeckx, Eindhoven (NL); Toon Hendrik Evers, Eindhoven (NL); Marlieke Joan Overdijk, Eindhoven (NL); Monica Scholten, Eindhoven (NL); Nicole Henrica Maria Smulders, Eindhoven (NL); Joost Hubert Maas, Eindhoven (NL); Bernardus Jozef Maria Beerling, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 102 days.

(21) Appl. No.: 15/318,113

(22) PCT Filed: May 28, 2015

(86) PCT No.: PCT/EP2015/061894
§ 371 (c)(1),
(2) Date: Dec. 12, 2016

(87) PCT Pub. No.: WO2015/193076
PCT Pub. Date: Dec. 23, 2015

(65) Prior Publication Data

US 2017/0120241 A1 May 4, 2017

(30) Foreign Application Priority Data

Jun. 16, 2014 (EP) ..... 14172491

(51) Int. Cl.
*B01L 3/00* (2006.01)

(52) U.S. Cl.
CPC ..... *B01L 3/50273* (2013.01); *B01L 3/502723* (2013.01); *B01L 2300/087* (2013.01); *B01L 2400/0406* (2013.01)

(58) Field of Classification Search
CPC ..... B01L 3/50273; B01L 3/502723; B01L 2400/0406; B01L 2300/087;
(Continued)

(56) References Cited

U.S. PATENT DOCUMENTS

2001/0039059 A1* 11/2001 Freitag ..... G01N 33/54366 436/514
2002/0025279 A1 2/2002 Weigl
(Continued)

FOREIGN PATENT DOCUMENTS

RU 137385 U1 2/2014
WO 2013024381 A1 2/2013

*Primary Examiner* — Lore R Jarrett

(57) ABSTRACT

The invention relates to a cartridge (10) for processing of a liquid sample, for example for the detection of components in a sample of blood. The cartridge comprises a fluidic system with an intake port (12) leading via an intake capillary channel (13) to a storage chamber (14). Moreover, a feeding capillary channel (15) leads from the storage chamber (14) to a detection chamber (16). The design of the cartridge (10) is such that the intake capillary channel (13) that connects the intake port (12) to the storage chamber (14), has a capillary suction pressure sufficiently high to drive some sample from the intake port to the storage chamber without need of any additional pressure. Furthermore the cartridge a flow control element (18, 20) adapted to be externally controllable such that the sample can be drawn from the storage chamber (14) towards the processing chamber (16) without any active pumping.

19 Claims, 5 Drawing Sheets

(58) Field of Classification Search
CPC ..... B01L 3/502715; B01L 2400/0688; B01L 2400/0487; B01L 2300/0877; B01L 2300/0681; B01L 2200/0621; B01L 2200/027; B01L 3/502746; B01L 2300/0816
See application file for complete search history.

(56) References Cited

U.S. PATENT DOCUMENTS

| | | | | |
|---|---|---|---|---|
| 2004/0096358 | A1 | 5/2004 | Blankenstein | |
| 2004/0206408 | A1 | 10/2004 | Peters | |
| 2006/0093526 | A1 | 5/2006 | Faulstich | |
| 2007/0025875 | A1 | 2/2007 | Peters | |
| 2007/0092407 | A1* | 4/2007 | Xiao ..... | B01L 3/50273 422/82.05 |
| 2010/0050751 | A1 | 3/2010 | Lee | |
| 2010/0112723 | A1 | 5/2010 | Battrell | |
| 2010/0261286 | A1 | 10/2010 | Kim | |
| 2011/0039285 | A1 | 2/2011 | Antonio | |
| 2011/0126913 | A1 | 6/2011 | Banerjee | |
| 2012/0118392 | A1 | 5/2012 | Blankenstein | |
| 2012/0225491 | A1 | 9/2012 | Ram | |
| 2015/0314288 | A1 | 11/2015 | Prins | |

* cited by examiner

CARTRIDGE FOR FAST SAMPLE INTAKE

CROSS-REFERENCE TO PRIOR APPLICATIONS

This application is the U.S. National Phase application under 35 U.S.C. § 371 of International Application No. PCT/EP2015/061894, filed on May 28, 2015, which claims the benefit of European Patent Application No. 14172491.4, filed on Jun. 16, 2014. These applications are hereby incorporated by reference herein.

FIELD OF THE INVENTION

The invention relates to a method and a cartridge for processing a liquid sample. Moreover, it relates to a microfluidic device and to an injection mold for injection molding a microfluidic device.

BACKGROUND OF THE INVENTION

The WO 2013/024381 A1 discloses a cartridge in which sample fluid is introduced into an inlet port. Further advancement of the sample fluid into sample chambers is enabled by opening a venting port.

SUMMARY OF THE INVENTION

It would be advantageous to have a cartridge for processing a liquid sample, e.g. a sample of blood, which is easy to use in everyday applications for example in hospitals and/or in a general practitioner office.

This object is addressed by a cartridge according to claim 1, an apparatus according to claim 13, a method according to claim 14, an injection mold according to claim 17, and microfluidic devices according to claims 18 and 19. Preferred embodiments are disclosed in the dependent claims.

According to a first aspect, an embodiment of the invention relates to a cartridge for processing a liquid sample, particularly an aqueous liquid such as a droplet of blood, blood plasma, saliva, urine or other liquid. The cartridge comprises the following components:

- An intake port through which the sample can be placed or taken up.
- A storage chamber in which the sample can intermediately be stored.
- A first capillary channel that is called "intake capillary channel" in the following and that connects the intake port to the storage chamber.
- A processing chamber in which processing of the sample can take place.
- A second capillary channel that is called "feeding capillary channel" in the following and that connects the storage chamber to the processing chamber.
- a flow control element adapted to be externally controllable such that the sample can be drawn from the storage chamber towards the processing chamber without any active pumping.

As usual, the term "cartridge" shall denote an exchangeable element or unit with which a sample can be provided to a device for processing. In the case of a biosensing system the device would typically be called the "analyzer" or "reader". It comprises a fluidic system into which a sample can be taken up from the environment. The cartridge will usually be a disposable component which is used only once for a single sample.

The size of the storage chamber is preferably such that a quantity of sample can be accommodated that is sufficient for the intended processing.

The terms "capillary channel" and "capillary suction pressure" refer to the effect of "capillarity" which is based on molecular interaction between the interior surfaces of the cartridge and the sample liquid at hand: so called capillary forces. In the context of the present invention, said capillary forces will typically (but not exclusively) apply to an aqueous sample liquid, e.g. to a sample of whole blood or (pure) water. This means that if such an aqueous liquid sample is provided, it will passively be taken up by attractive capillary forces drawing the liquid into the fluidic system. With passively is meant that no other "active" pumping mechanism is used (such as e.g. by suction mechanical means or opening a valve to some source with a decreased gas pressure, or by gravity etc.). Especially in the case of very small sample volumes it is advantageous to use "passive" or "autonomous" filling because stopping of flow can be done very precisely, controlled by the geometrical features in the cartridge. Active flow would involve complicated measurement of the state of the filling and in time feedback of the information to the pumping mechanism.

Fluid transport of a liquid column by capillary forces is caused by the pressure difference between two locations in the liquid close to the both interfaces of the column with the surrounding medium (in the context of the present invention typically air). For convenience a relative pressure scale is used, where the ambient air pressure (which is assumed to prevail adjacent to both interfaces outside the column) is set to zero (reference level). In this sense a capillary pressure causing the filling of a structure is mathematically speaking a negative pressure. Throughout this text the wordings "a larger (or lower) capillary suction pressure" are used for a negative capillary pressure with a greater (or smaller) absolute value.

The processing in the processing chamber may in general be any kind of desired manipulation with a sample liquid at hand. It may for example comprise a mechanical, chemical, and/or biological transformation of the sample liquid. Preferably, the processing comprises a measurement with which parameters of the sample liquid can be detected. Processing could also include analysis for certain analytes using a biomolecular method (assay).

The feeding capillary channel may connect the storage chamber to the processing chamber directly or indirectly (i.e. via additional components such as a portion of the intake capillary channel).

Furthermore, the design of the listed components may be such that said first capillary suction pressure (exerted by the intake capillary channel and the storage chamber) is lower than a second capillary suction pressure (i.e. the one exerted by the feeding capillary channel and the processing chamber).

The condition that "the capillary suction pressure exerted by the intake capillary channel and the storage chamber is lower than the capillary suction pressure exerted by the feeding capillary channel and the processing chamber" implies that a sample is (or can be) autonomously transported from the storage up to the processing chamber just by capillary forces (if its flow is not prevented by closure of the flow control element).

With the help of the "flow control element" it can be guaranteed that a sample is first taken in by the intake capillary channel and the storage chamber and that it is only thereafter (i.e. after suppression of forwarding is ended by opening the flow control element) forwarded towards the processing chamber. The flow control element can be realized in many different ways, including the designs of microfluidic valves that are known in the state of the art. In a preferred embodiment, the flow control element comprises a layer or sheet of material (or "foil") that initially closes a vent port and that can be disrupted or moved to open the port. A foil that can be disrupted can be realized very cost-effectively and is particularly suited for a disposable cartridge that shall be used only once. The foil can for instance be disrupted or moved by a mechanical, chemical, thermal, optical, and/or electromagnetic operation. A mechanical operation may for instance comprise piercing of the foil by some tip or blade, or pushing of the foil by some plunger. A chemical operation may comprise the dissolution of the foil by a chemical reagent. A thermal operation and an optical operation may comprise the melting of the foil by heat or irradiation. An electromagnetic operation may comprise the movement of the foil (from a closed to an open position) by electrical and/or magnetic forces.

According to a second aspect, an embodiment of the invention relates to a method for processing a liquid sample, said method comprising the following steps:

a) Drawing the sample by first capillary forces into a storage chamber while a flow control element is closed, wherein forwarding of sample from the storage chamber towards a processing chamber can controllably be suppressed by said flow control element.

b) Opening the aforementioned flow control element to forward the sample by second capillary forces that are stronger than the first capillary forces into the processing chamber.

c) Processing of the sample in the processing chamber.

The method comprises in general form the steps that can executed in a cartridge of the kind described above. Explanations provided for the cartridge are therefore analogously valid for the method, too, and vice versa. In particular, drawing of sample into the storage chamber may occur via an intake port and a subsequent intake capillary channel. Additionally or alternatively, forwarding of sample may take place via a feeding capillary channel.

The described cartridge and the method have the advantage to allow for a convenient and reliable manipulation of a sample by a user as said sample is first taken up into a storage chamber and only thereafter forwarded to a processing chamber. The step of sample uptake can hence be executed independently of the step of processing. In particular, the sample uptake can be optimized for minimum duration. At the same time, a reliable and autonomous transport of the sample towards the processing chamber is guaranteed due to the relation between the capillary suction pressures exerted in the sample uptake area and the sample processing area. Furthermore the filling of the processing chamber itself and the subsequent processing under control of a device/analyzer may be time critical processes. And even more, the processing itself may require involvement of the device/analyzer, e.g. for heating, mixing, handling of magnetic beads, camera controls, detection. Therefore it is essential that the transport of sample to the processing chamber is only done when the cartridge is under control of the device, so when it has been inserted into it.

In the following, various preferred embodiments of the invention will be described that can be realized in combination with the cartridge as well as the method (even if they are described here in detail only for one of the cartridge or the method).

The desired relation between the capillary suction pressures in the intake part and the processing part of the cartridge, respectively, can be achieved by various measures, for example by an appropriate surface preparation of the associated components. In a preferred embodiment the surface characteristics (resulting in a liquid contact angle of the capillary elements) are (roughly) the same throughout the cartridge.

In general, capillary pressures are related to the curvature(s) of the liquid meniscus (Laplace's law). For given contact angles, these curvatures depend on the geometry of the channel and the liquid contact angle (Young-Laplace's law). For a channel with a roughly rectangular cross-section the capillary pressure depends on the height and the width of the channel. So relative magnitudes of capillary suction pressures in the intake part and the processing part of the cartridge, respectively, can be designed by choosing the appropriate channel dimensions. In particular, the shape and dimensions of the cross section of the feeding capillary channel may be chosen different from the shape of the cross section of the storage such that the desired relation of capillary suction pressures is achieved.

The relative capillary suction pressures determine the DIRECTION of the flow: so, during sample intake the sample flows via the sample intake port and the capillary intake channel into the storage chamber. After opening of a vent the stored liquid is forwarded to the processing chamber(s). Especially this is possible because the suction pressure of the storage (required for sample intake) is smaller than the capillary suction of the feeding capillary channel and the processing chamber(s).

The FLOW RATES_are important for the filling time requirements. The flow rates depend on the hydraulic resistance of the various elements and on the pressure difference induced by capillarity. Hydraulic resistance depends, again, on the shape of the cross-section of e.g. a channel, albeit in a different way than the capillary pressure. Furthermore the hydraulic resistance depends on the length of a channel, whereas the pressure does not.

In absolute figures, the cross section of the feeding capillary channel is typically between about 100×100 micrometers$^2$ and about 200×200 micrometers$^2$. The storage chamber is typically 500 to 700 micrometers deep, It's width and length are much larger, chosen to accommodate the range of liquid volumes involved (typically 1 to 50 microliters). Given these dimensions, the suction by the storage chamber is very roughly 3 to 4 times as small as the suction by the feeding channel.

In order to provide for short filling times of the storage chamber, despite its relatively low suction pressure, the intake capillary channel preferably has a low flow resistance, for example by designing it as short as possible. In other words, the entrance of the storage chamber shall be disposed as close as possible to the intake port. Typically a length of 1 to 2 mm can yield sufficiently small uptake times for a blood sample.

In another embodiment, the feeding capillary channel branches from the intake capillary channel, i.e. the inlet of the feeding capillary channel is disposed somewhere between the beginning of the intake capillary channel (at the intake port) and its end (at the storage chamber). Sample that is forwarded to the processing chamber is hence taken up somewhere between the intake port and the storage chamber. In this way a "Last In First Out" (LIFO) principle is realized, i.e. sample liquid which was taken up last (and hence resides between intake port and storage chamber) is first forwarded towards the processing chamber. This has the advantage that presence of sample at the entrance of the feeding capillary channel is guaranteed even with the smallest amount of sample, thus enabling error-free forwarding to the chambers as soon as a vent of the chambers has been opened. Moreover, the fact that the feeding capillary channel has its entrance between intake port and the entrance of the storage chamber makes it possible to control the balance between intake times and forwarding times via the associated capillary suction pressures of the intake part and the processing part, respectively. The entrance of the feeding capillary channel is preferably located in an interior section ranging from about 10% to about 90%, most preferably from about 20% to about 80% of the extension of the intake capillary channel.

The storage chamber may at least partially be bordered by a transparent window. The correct filling of the storage chamber up to a certain minimally required level can then readily be controlled by a user by visual inspection, thus providing a positive feedback about an error-free execution of the intake procedure (=sample adequacy indication, SAI)

The cartridge may optionally comprise at least one set of pinning structures to temporarily hold the liquid front in the internal corners of the storage chamber. This can be helpful to prevent formation of a not well shaped liquid front which could lead to ambiguity of the judgment of "sample adequacy" by a user or an analyzer device.

Additionally or alternatively, marks indicating thresholds for a minimum and maximum filling can be added. The actual positioning of a sample with respect to such marks may for example visually be controlled by a user in the aforementioned embodiment in which the storage chamber is bordered by a transparent window through which the indicator marks can be inspected.

The storage chamber and/or the processing chamber may preferably be connected to a vent port, i.e. a port through which the medium initially filling the storage chamber or processing chamber (typically air) can escape to make room for the sample liquid entering the respective chamber. Optionally, such a vent port may be controllable, wherein controllability of the vent port(s) means that closing and opening of the vent port(s) can externally be controlled, for example by a user or by a device/analyzer. The vent port(s) may for example initially be closed by a tape that can be punctured or torn off by a user to open the port(s), allowing the escape of air and entering of sample fluid into the associated chamber. Especially control of forwarding of the sample by an analyzer is useful for time critical processing or analysis of sample under control of the analyzer.

It should be noted that the aforementioned provision of a (initially closed) vent port that is connected to the processing chamber can be used to increase the gas pressure in the processing path as soon as a very small amount of liquid enters the feeding capillary channel, which stops the flow as soon as this pressure counterbalances the capillary suction pressure by the feeding channel. The vent port hence functions as a "flow control element" in the sense of the present application.

In a particular embodiment, the storage chamber may be connected to a permanently open vent port, while the processing chamber is connected to a controllable vent port that is initially closed.

The cartridge or at least parts of the interior surfaces of the intake port, the intake capillary channel, the storage chamber, the feeding capillary channel and/or the processing chamber may optionally be manufactured from a material or given a treatment (such as coating) to make the surface hydrophilic.

The processing chamber may preferably be designed to allow for optical measurements. This may particularly be achieved by providing the processing chamber with one or more transparent windows or walls. Optionally, the whole cartridge may be made from a transparent material such as polystyrene, COC, COP, polycarbonate. The processing chamber may particularly be designed to allow for measurements by frustrated total internal reflection (FTIR) as it is described in more detail in the WO 2008/155716.

The invention further relates to an apparatus for processing a sample fluid in a cartridge according to any of the embodiments described above, said apparatus comprising:

- A sample-adequacy detector for detecting if a desired amount of sample has been taken up by the cartridge.
- An opening actuator that can open the flow control element of the cartridge if the sample-adequacy detector has detected a desired amount of sample.

The sample-adequacy detector may for example comprise on optical device such as a photodiode, an image sensor and/or a light barrier by which progress of a sample beyond a given threshold in the storage chamber can be detected.

Of course the apparatus may further comprise other components serving for (important) functions such as heating, mixing, magnetic actuation, or detection. This largely depends on the type of processing the apparatus is intended for.

The opening actuator may for example comprise at least one of the following elements:

- an instrument for mechanically disrupting (e.g. piercing) a foil;
- a heating unit for thermally disrupting (e.g. melting) a foil;
- a light source for irradiating a foil, which will typically also lead to the destruction of the foil (e.g. by melting).

The duration of drawing the sample liquid into the storage chamber in step a) of the method is preferably short. In absolute figures, the duration of drawing the sample liquid into the storage chamber in step a) of the method is preferably less than about five seconds, most preferably less than about three seconds. Short times for filling the storage chamber increase the convenience for the user who has to apply the cartridge and, dependent on the filling method, also for the patient the sample is taken from (e.g. if the sample is transferred directly from a finger prick). Moreover, short filling times reduce the risk of errors that may occur due to wrong or unskillful manipulation by a user.

The presence of a vent port that is connected to the processing chamber can particularly be used to initiate the forwarding of sample in step b) of the method by the opening of said vent port.

In general, the described cartridge is suitable for at least two use cases with no changes of its design:

In a first use case, sample is taken up into the cartridge by bringing the cartridge to the "body site" where a tiny droplet of sample is made available (e.g. blood of finger prick, heal prick, ear lobe etc.). Sample taking is stopped when the user visually observes that a sufficient amount of sample has been taken up (SAI). The filled cartridge is then put into a device such as an analyzer. The mere insertion of the cartridge in the device is preferably taken as a signal to the device that the processing can start. An analyzer prepares for example for the process and starts "forwarding" the sample to the detection chamber(s) when appropriate.

In a second use case, the cartridge is first inserted into a device such as an analyzer. The flow control element of the processing chamber is still closed. Sample is then brought to the device/cartridge combination. The user can stop "giving" sample when he/she visually observes that sufficient sample has been taken up OR when the device detects this (e.g. optically) and gives a signal to the user. The user and/or the device can next give a signal to the device that processing (e.g. preparations for analysis) can start. An analyzer may for instance prepare for the process and start "forwarding" the sample to the processing chamber(s) when appropriate.

According to another aspect, an embodiment of the invention relates to an injection mold for manufacturing a microfluidic device with at least one channel by injection molding of a thermoplastic material. A special example of such a microfluidic device is a cartridge according to any of the embodiments described in this application. The injection mold comprises the following components:

- A first mold body with a first projection that corresponds to a first portion of the channel of the microfluidic device.
- A second mold body with a second projection that corresponds to a second portion of said channel.

Moreover, the microfluidic device has the following features:

- Said first and second projections of the first and second mold body, respectively, contact each other (when the mold is assembled for usage) at a transition line to join the first and second portions of the channel.
- The first mold body and/or the second mold body comprises an additional projection for generating a fluidic element that compensates for a possible flow barrier imposed by the transition line.

The term "mold body" shall denote a part of an injection mold that comprises a surface area which is contacted by the thermoplastic injection material and hence influences the final shape of the manufactured product. Typically, an injection mold comprises two or more mold bodies that can be assembled to form a closed cavity which is filled with initially molten injection material which thereafter solidifies.

The first mold body may optionally be an "insert" that is partially or completely housed by the second mold body.

A "projection" of a mold body shall generally refer to an element or structure disposed in the surface area which is contacted by the thermoplastic injection material such that this element or structure determines a part of the shape of the manufactured product. Typically, such a "projection" will be an elevation in a more or less planar local environment such that it produces some kind of recess or hole in the manufactured product.

The above mentioned "fluidic element" shall refer to any kind of element, structure, or component with a geometry that influences the flow of a fluid through the channel in which the fluidic element is located in the way described above (i.e. such that a possible flow barrier imposed by the transition line is compensated for). The fluidic element is a passive component as its effect on the flow is substantially only produced by its geometry.

The invention further relates to a microfluidic device, particularly a cartridge, that can be produced by injection molding with the above described injection mold.

Moreover, the invention relates to a microfluidic device which comprises at least one channel that is crossed by a transition line generated by different mold bodies of an injection mold used for manufacturing the microfluidic device. The device may particularly be a microfluidic device of the kind described above and/or a cartridge according to any of the embodiments described in this application. It is characterized in that its channel comprises a fluidic element that compensates for a possible flow barrier imposed by the transition line.

The above microfluidic devices are based on the same concept as the injection mold, i.e. the provision of a fluidic element that compensates for a possible flow barrier caused by a transition line. Explanations and embodiments provided for one of the microfluidic devices are therefore analogously valid for the other microfluidic device and the injection mold and vice versa.

An economic and technically feasible manufacturing of plastic products is achieved by injection molding using at least two mold bodies. Typical of this approach is that transition lines occur along the boundaries where the mold bodies meet, wherein these lines may yield a more or less pronounced transition step in the resulting product. In connection with the manufacturing of microfluidic devices, such a transition step may impede fluid flow if it occurs within a channel of the device. The above described microfluidic devices and the injection mold have the advantage to overcome this problem by introducing an additional fluidic element in an affected channel at the transition line.

In the following, various preferred embodiments will be described that can be realized in combination with the above microfluidic devices and the injection mold (even if they are described in detail only for one of these embodiments).

According to one preferred embodiment, the fluidic element may be designed such that it enables or supports a flow of a (e.g. aqueous) fluid from the first to the second portion of the channel. Most preferably, the fluidic element is designed such that it enables or supports a flow of fluid only in this direction but not in the reverse direction. In the latter case, the fluid element acts as a kind of "diode" with respect to the supported direction of fluid flow.

In another embodiment, the additional projection that generates the fluidic element in the injection molded product is designed as an enlargement of the first projection on the first mold body. This means that the first projection has some standard or basic size which is augmented, at least in a limited area, by the aforementioned enlargement. The standard or basic size of the first projection may for example correspond to a channel in the manufactured product having a constant (or otherwise regularly shaped) cross section (said cross section by definition being measured perpendicularly to the intended flow direction in the channel). In this case the "enlargement" corresponds to a broadening of the resulting channel.

The aforementioned additional projection in the form of an enlargement may preferably be dimensioned such that a decrease in cross section occurs at the transition from the first to the second portion of the channel irrespective of the transition line (i.e. irrespective of the particular change in cross section that is caused by the transition line in deviation from the ideal case of no change due to usual manufacturing tolerances). Fluid arriving at the end of the channel part that is formed by the additional projection will therefore always continue flowing into the subsequent second portion of the channel driven by capillary forces.

According to a further development of the embodiments with an additional projection in the form of an enlargement, said enlargement is designed to create a continuous increase of the cross section of the first portion of the channel up to the transition to the second portion of the channel. Hence no sudden, step-like changes of the cross section of the channel occur at the fluidic element that is formed by the additional projection, which ensures that fluid flow is not stopped by the fluidic element.

BRIEF DESCRIPTION OF THE DRAWINGS

These and other aspects of the invention will be apparent from and elucidated with reference to the embodiments described hereinafter.

In the drawings.

Like reference numbers refer in the Figures to identical or similar components.

DETAILED DESCRIPTION OF EMBODIMENTS

Figure 1:
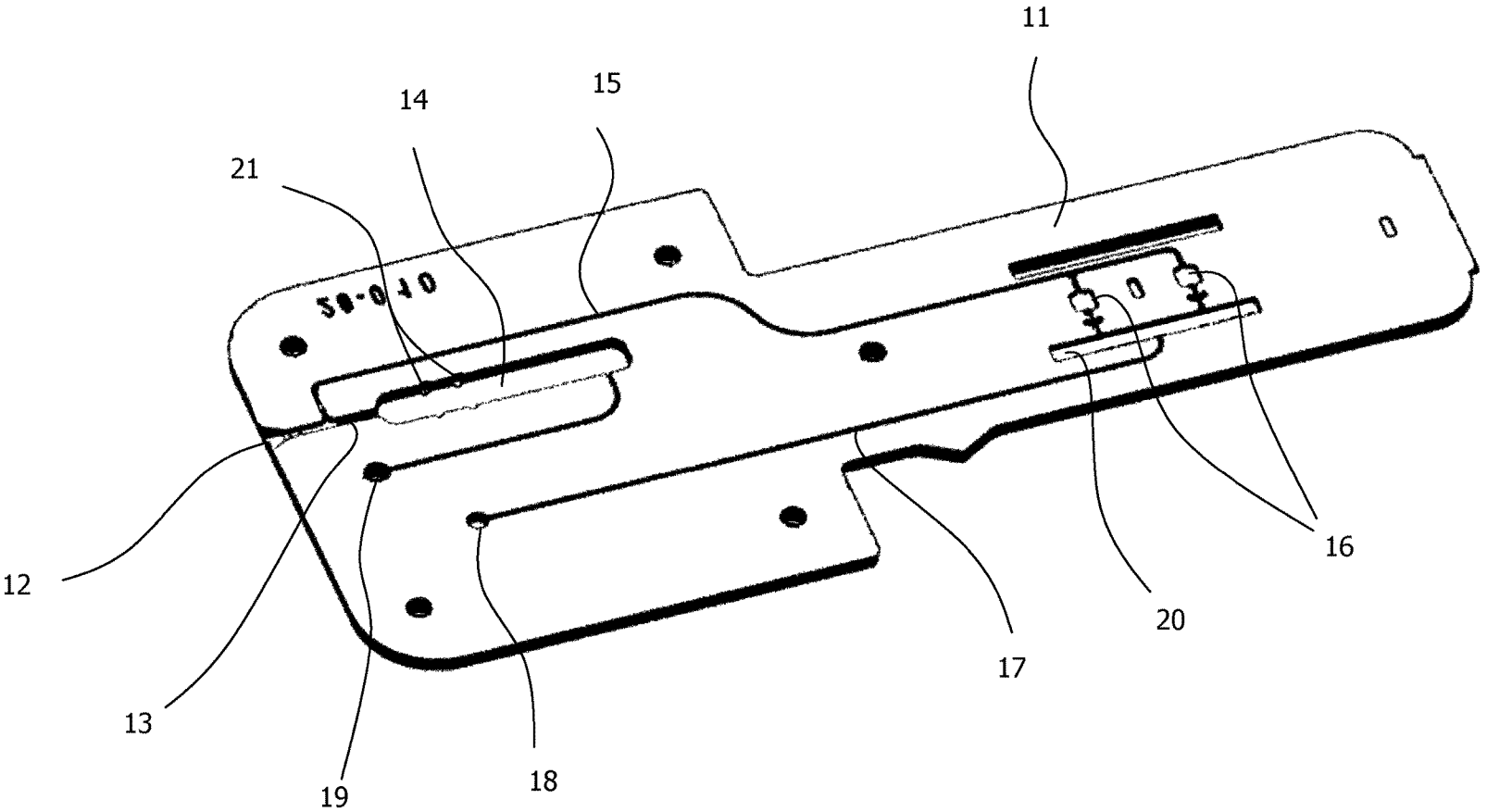
FIG. 1 shows a top view onto the injection molded base part of a cartridge according to an embodiment of the invention.

Cartridges with interior (micro-) fluidic systems are used for transferring small samples of biological fluids, e.g. blood or saliva, to an appropriate processing apparatus such as an optical detector. With respect to an everyday usage in a hospital environment or a general practitioner office, such cartridges should preferably fulfill at least one of the following demands:

- Sample intake time should be short. This should preferably take not more than a few (e.g. 3) seconds, because of the limited patience of an end-user to accurately align the sample inlet with the sample droplet.
- Sample intake should be "first-time-right".
- Filling time of the detection chambers should be short, e.g. within the order of one minute.
- The volume of sample should be small. Additional functions such as storage and sample adequacy indication should not consume additional volume or time.

An embodiment of a cartridge that addresses at least some of these objectives is proposed here, said cartridge having at least one of the following design features:

- It has a storage chamber to contain the sample after uptake and until analysis. The dimensions of the storage chamber are chosen to have a capillary suction pressure, sufficiently large to enable short filling times, but sufficiently small to enable short filling times of the detection chambers as filling of the chambers is slowed down by the back-suction of the storage.
- The entrance of the sample storage chamber is close to the sample intake port in order to promote a short filling time of the sample storage chamber.
- The capillary pressure profile from the sample intake port to the sample storage chamber and from the sample storage chamber to the detection chambers is designed in such a way that liquid can always flow autonomously, i.e. from a region with a lower capillary suction pressure to a region with a larger capillary suction pressure.
- Error-free filling of the chambers and the necessity of only a small sample volume are promoted by positioning the entrance of the detection chamber feeding capillary channel between the sample intake port and the sample storage chamber (thus realizing a "Last In First Out" principle).
- A sample adequacy indicator (SAI) is provided on the sample storage chamber. In combination with the aforementioned arrangement of the feeding channel, a positive signal on the SAI also means that the detection chamber feeding capillary channel is properly wetted for further filling (because the SAI is only reached after the entrance of the feeding capillary channel). The SAI can be read by a user and/or by a detector of a device such as an analyzer. Because the SAI is close to the intake port, there is no time delay for necessary fluid transport between the actual moment of "sample sufficient" and the indication thereof.

A concrete embodiment of a cartridge for the uptake and processing of a sample medium may comprise at least one of the following components and features:

- A sample intake port.
- A storage chamber.
- A first capillary channel ("intake capillary channel") coupling the sample intake port to the storage chamber.
- A detection chamber (or, more generally, a "processing chamber").
- A second capillary channel ("feeding capillary channel") coupling the intake capillary channel to the detection chamber, wherein one end of the feeding capillary channel is positioned between the sample introduction port and the storage chamber.
- The (capillary) under-pressure of the storage chamber is lower than the under-pressure in the detection chamber.
- The storage chamber comprises a window through which it is possible to visualize its filling.

Figure 2:
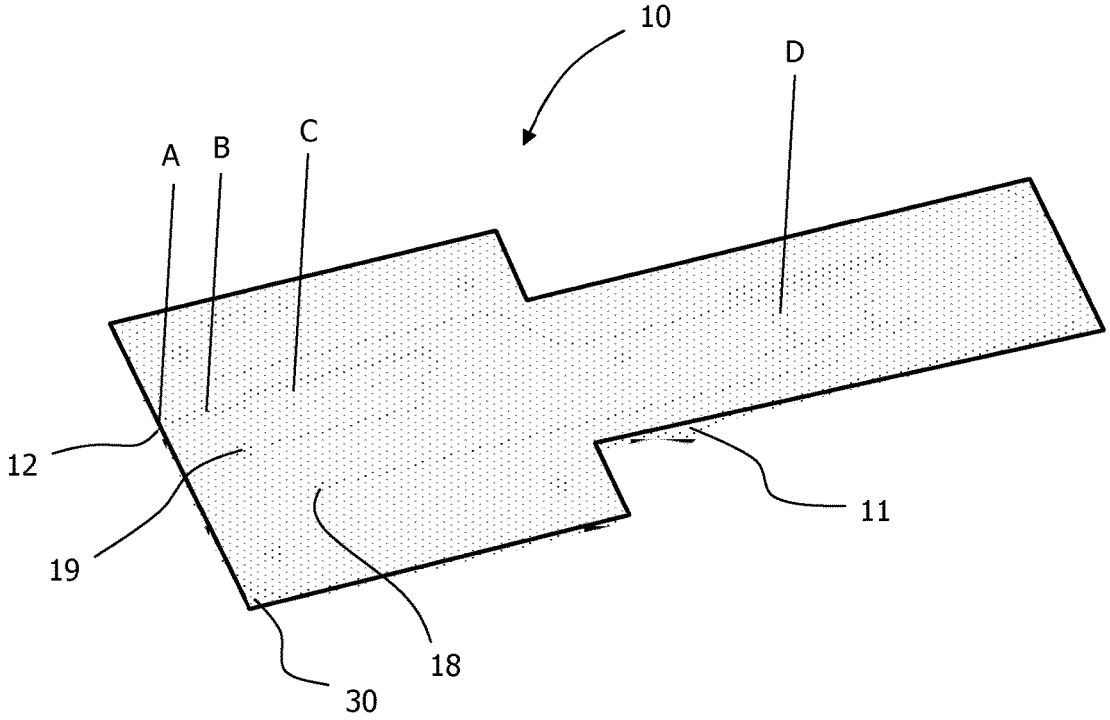
FIG. 2 shows the completely cartridge after addition of a cover.

FIG. 1 schematically shows the injection molded base part 11 of an embodiment of a cartridge 10 that is designed according to the above principles. FIG. 2 shows the complete cartridge 10 that is achieved after adding a cover 30 on top of the base part 11. Preferably, the components of the cartridge 10 are as far as possible designed to be compatible with existing technologies, for example with the Magnotech® technology developed by the applicant.

The base part 11 is preferably made by injection molding from a transparent plastic (e.g. polystyrene, polycarbonate, COP, COC etc.). A (micro-) fluidic system is generated in the surface of the base part 11 during injection molding. The essential components of this fluidic system are now described in the sequence they are passed by a sample liquid during usage of the cartridge 10.

Sample liquid such as a few microliter of blood (e.g. taken directly from a finger prick, or provided via a syringe or a pipette) is taken up into the cartridge 10 via a funnel-shaped sample intake port 12 located at the front side of the base part 11.

This intake port 12 is connected via a first or "intake capillary channel" 13 to a storage chamber 14. The storage chamber 14 is large enough to accommodate a quantity of sample that is sufficient for the intended later detection procedure. The storage chamber 14 comprises at least two sets of pinning structures 21 that prevent premature liquid flow along the ribs of the storage to ensure that the liquid front is properly shaped and can be used for reliable reading of the sample adequacy indicator (SAI), i.e. a user can verify that a sufficient amount of sample has been drawn if the level of the sample is between these structures. Furthermore, the storage chamber 14 is connected by a venting channel to a first vent port 19 that allows for the escape of air from the storage chamber. The first vent port 19 may initially be closed or permanently be open, e.g. via a hole in the base part 11.

A second or "feeding capillary channel" 15 is provided that branches from the intake capillary channel 13 and leads to an elongated back-end of the base part 11 in which (here two) parallel detection chambers 16 are disposed. The branching point of this feeding capillary channel 15 is roughly located in the middle (i.e. at about 50%) of the length of the intake capillary channel 13, though other positions may be chosen, too. The cross sections of the channels 13 and 15 are designed in such a way to give the fastest filling. The intake capillary channel 13 may for example have a cross section of about 500 μm×250 μm, while the feeding capillary channel 15 has a cross section of about 200 μm×200 μm.

The exits of the detection chambers 16 are connected via a venting channel 17 to a second vent port 18 in the front section of the base part 11. This second vent port 18 must controllably be opened, to allow for the escape of air from the detection chambers such that sample can flow through the feeding capillary channel 15 into the detection chambers 16. Alternatively the vent can be opened on location 20 which may be better accessible for a mechanism in the device/analyzer.

FIG. 2 shows the finished cartridge 10 after addition of a cover 30 (e.g. a lidding laminate) on top of the base part 11. The cover 30 closes channels and chambers in the base part 11, thus accomplishing the interior fluidic system of the cartridge. The only opening to the outside of this fluidic system is initially the intake port 12 and the vent 19.

The cover 30 is preferably transparent to allow for a visual inspection of the storage chamber 14. It may also contain a reference marker (not shown) which serves as a guide for the eye for judgment if a sufficient amount of sample has been taken up. Moreover, the cover 30 can be punctured at the positions of the vent ports 18 and/or 20 and 19 to allow for a controllable escape of air from the associated chambers. In particular, the first vent port 19 connected to storage chamber 14 can first be punctured to allow for the intake of sample and filling of the storage chamber (if it is not already open right from the beginning). Next, the second vent port 18 and/or 20 connected to the detection chambers 16 can be punctured after the cartridge 10 has been transferred to a detection device and if the detection of the sample in the detection chambers 16 shall start.

Depending on the intended way of filling the cartridge with a sample (e.g. finger stick, via a pipette, etc.), the cover 30 may not end exactly at the edge of the base part 11 near the intake port 12 (as shown in FIG. 2) but rather end a distance away from the edge (either in front of or beyond it).

The base part 11 is preferably hydrophilized to give it a low contact angle that enables capillary flow. Filling by capillary flow is autonomous, low cost, reliable, and relatively simple to implement. The cover 30, on the contrary, may optionally be hydrophobic.

In general, there are two main use cases for the cartridge 10. In a first one, the cartridge is filled outside a device. The corresponding steps are then, if the device is for example an analyzer for blood samples:

The cartridge is contacted with a droplet of blood.

When the sample adequacy indicator gives its visual signal, the cartridge is removed from the blood droplet.

The cartridge is inserted into the analyzer.

The user tells the analyzer that sample taking has finished, e.g. by closing a cover, or actuating a knob.

The analyzer starts preparing the analysis.

The analyzer triggers transport of the sample to the detection area.

The analyzer detects if assay detection chamber is filled properly.

The analyzer performs analysis and reports about results.

In a second use case, the cartridge is filled while being coupled to a device. The corresponding steps are then, for the example of an analyzer:

The cartridge is inserted into the analyzer.

The cartridge is contacted with a droplet of blood.

When the sample adequacy indicator gives its visual signal, the finger with the blood droplet is released from the cartridge inlet.

The user tells the analyzer that sample taking has finished e.g. by closing a cover, or actuating a knob.

As above: The analyzer starts preparing the analysis, triggers transport of the sample to the detection area, detects if assay detection chamber is filled properly, performs analysis, and reports about results.

In the following, the pressures that are involved in a typical procedure using the cartridge 10 are explained in more detail with reference to FIGS. 3 and 4.

Figure 3:
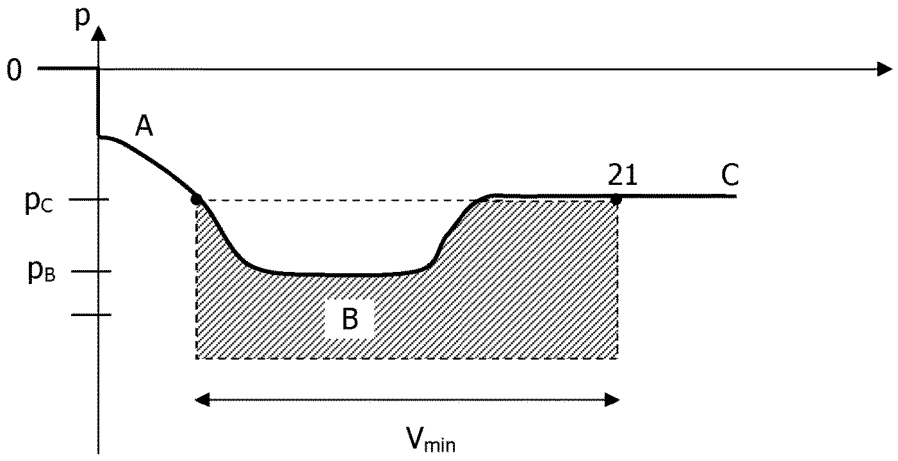
FIG. 3 illustrates the pressure profile in the cartridge of FIG. 2 during and after filling of the storage chamber.

FIG. 3 illustrates the capillary pressure profile in the cartridge 10 of FIG. 2 at positions along the intake path during and after filling of the storage chamber. Capillary suction pressures p are indicated as negative, i.e. the outside world (sample droplet) is at zero pressure (reference). The horizontal axis represents a distance or volume along the path (not to scale).

As a first step of filling, a droplet of sample at ambient pressure "0" (e.g. blood from a finger prick) is contacted with the sample intake port 12 at position "A". The droplet of blood should be larger than the minimum required amount of blood (typically about 3 μl). The storage chamber 14 must be larger than the maximum size of the sample (in the shown example it may be about 15 μl). By capillary force the sample is sucked into the intake capillary channel 13. It moves via position "B" into the storage chamber 14 (position "C"). The sample keeps on moving into the storage chamber because of the capillary under-pressure $p_C$ in said chamber relative to "0". The dimensions of the storage chamber 14 and the intake capillary channel 13 connecting point C of the storage chamber with the outside world (at point A) are such that filling with the minimum amount of sample can be done within a short time (preferably less than about 3 s). This is an important reason why the intake capillary channel 13 is short and why the storage chamber 14 is close to intake port 12.

The under-pressure $p_C$ in the storage chamber 14 cannot be increased too much to shorten the filling time because in a later stage, this pressure will compete with filling of the detection chambers. The feeding capillary channel 15 to the detection chambers 16 (leading from point B to point D) does not fill with liquid during the intake phase because the vent ports (18 and 20) of the detection chambers are still closed.

Sample intake goes on until the contact of the sample droplet with the intake port 12 is interrupted by the user at the moment that he/she observes that a sufficient amount of sample is present. The user can see the liquid inside the storage chamber 14 through a window, which is preferably located at the position corresponding with the minimum required amount of sample ("sample adequacy indicator" SAI). The pinning structures 21 inside the storage chamber cause the liquid to have a front which is perpendicular to the direction of flow, enabling a reliable read-out of the SAI. When the 3 μl mark is reached, the user can stop offering the sample. From that moment on no sample flows into the sample intake port at A. The flow of the liquid column goes on until the front in the intake channel reaches a location with a capillary pressure equal to the capillary pressure $p_C$ in the storage.

FIG. 3 illustrates the capillary pressure profile from the sample intake port 12 at A via intake capillary channel 13 at B to the storage chamber 14 at C. Position "21" corresponds roughly with the pinning structures 21 at the minimum volume ($V_{min}$). The hatched area represents the region where liquid is when exactly the minimum volume is present. Pressures on both sides of the sample pool are equal to the under-pressure $p_C$ in the storage chamber.

The storage chamber 14 has a somewhat smaller capillary under-pressure $p_C$ (negative pressure) than the intake port ($p_A$). This serves to a slight retraction of the sample inside the intake port. As can be seen from FIG. 3, the largest capillary under-pressure $p_B$ (smallest channel dimensions) is in the intake capillary channel at B.

After sample intake is complete, the cartridge can be placed into the analyzer, which can take control of proper filling of the detection chambers 16. The same process can however also be executed when the cartridge is already in the analyzer before and during sample intake.

With a cartridge with properly filled storage chamber 14 in the analyzer, the analyzer must initiate filling of the detection chambers 16. This process is software driven and could itself be initiated by a signal given by the user (e.g. a knob, a lever, closing a lid) or by the analyzer (e.g. sensing presence of the sample).

Actual initiation of the filling occurs by opening of a vent port, for example at position 20 (or at vent port 18) by puncturing of the lidding foil with a puncturing element present in the analyzer. Because the entrance to the feeding capillary channel 15 is located at B between positions A and C, sample is always present at this entrance (LIFO principle).

Figure 4:
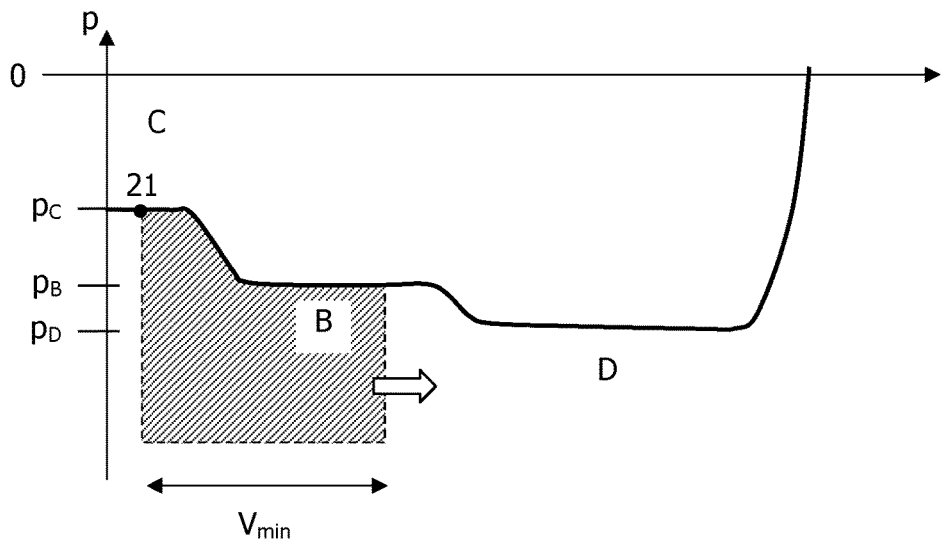
FIG. 4 illustrates the pressure profile in the feeding branch of the cartridge of FIG. 2 after filling of the storage.

FIG. 4 illustrates the pressure profile in the cartridge 10 of FIG. 2 at positions along the feeding path to the detection chambers after filling of the storage and before and during the initial phase of filling of the detection chambers. For simplicity the pressures of the feeding capillary channel 15 and of the processing/detection chambers 16 are represented by one element with a pressure pp.

The hatched area represents the location of the liquid after the sample intake step described above. The relevant capillary pressures for filling of the feeding capillary channel 15 are the under-pressure $p_B$ in said channel which is somewhat larger than the under-pressure pressure $p_C$ in the storage chamber 14 and the under-pressure pp which is again somewhat larger. Although there is a capillary pressure difference, in the direction C to B to D, actual filling of B and subsequently D does not take place because a counter-pressure has built up by compression of the air in the feeding channel and the detection chambers, as the vents 18 and 20 are still closed.

After opening of the vent 18 or 20, the sample moves further into the feeding channel in the direction of the detection chambers. The dimensions and therefore pressures are designed in such a way that the filling time of the channels and chambers fulfil the requirements. The back suction by the storage chamber 14 must not be too large. The sample flow halts when the fluidic stops in all chambers are reached.

Figure 5:
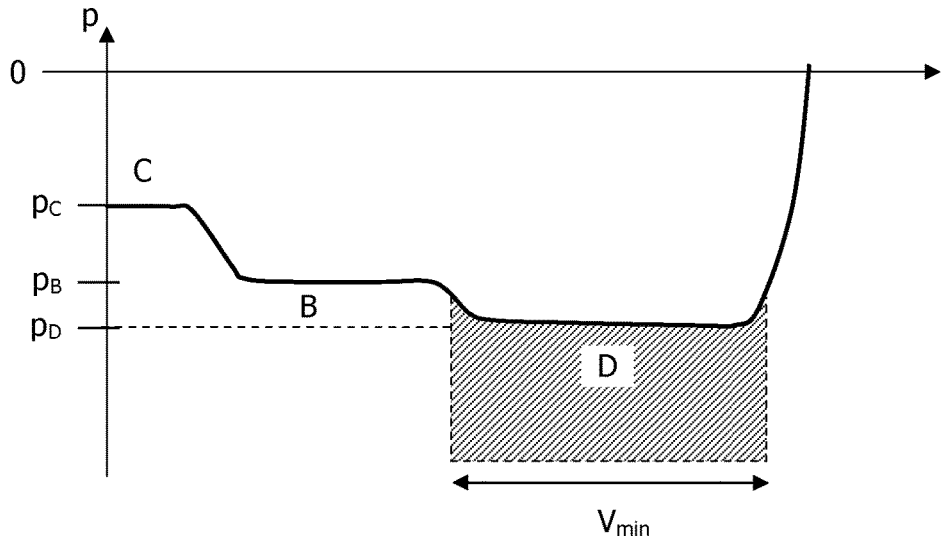
FIG. 5 illustrates the pressure profile in the feeding branch of the cartridge of FIG. 2 after filling of the detection chambers is accomplished.

FIG. 5 shows the capillary pressure profile from the storage chamber 14 at C via intake capillary channel to the feeding capillary channel 15 (at B) and the detection chambers 16 at D. Capillary pressures are again indicated as negative (suction). The hatched region (feeding channel and detection chambers) should be filled at least. The volume of that region defines the minimal volume $V_{min}$.

When a too small volume of sample is present, the liquid front on the storage side enters the channel beyond position B. In that case the sample does not reach the fluidic stop in one or more detection chambers, leading to non-reproducible results. With an excess of sample some sample will remain in the storage chamber and part of the intake port.

In summary, an embodiment of a cartridge for processing of a liquid sample such as for the detection of components in a sample of blood has been described. The cartridge comprises a fluidic system with an intake port leading via an intake capillary channel to a storage chamber. Moreover, a feeding capillary channel leads from the storage chamber to a detection chamber. The design of the cartridge is such that capillary suction pressure exerted by the intake capillary channel and the storage chamber is less than capillary suction pressure exerted by the feeding capillary channel and the detection chamber. Moreover, the storage chamber is preferably disposed close to the intake port to allow for short feeding times.

It should be noted that the described design of the cartridge is intended to use a small sample volume, for example less than about 3 μl. This is advantageous because it is less invasive for the patient and it takes a shorter time to take the sample. It is accomplished by a drastic reduction of the dead volume in the front-end of the cartridge. Ideally after filling of the chambers only the feeding channel contains an excess. Input channel and storage are then empty or almost empty (for robustness of the last stages of chamber filling).

As mentioned above, the base part 11 of the described cartridge 10 is preferably made by injection molding. A typical process of (micro-) injection molding comprises the transferring of a thermoplastic material in the form of granules from a hopper into a heated barrel so that it becomes molten and soft. The material is then forced under pressure inside a mold cavity where it is subjected to holding pressure for a specific time to compensate for material shrinkage. The material solidifies as the mold temperature is decreased below the glass-transition temperature of the polymer. After sufficient time, the material freezes into the mold shape and gets ejected, and the cycle is repeated. A typical cycle lasts between few seconds to few minutes.

Molds made for (micro-) injection molding may consist of a fixed part and one or more moving parts, depending on the design. Finished parts can be demolded with ejector pins that may be controlled hydraulically and electrically. For molds used in (micro-) injection molding, especially for microfluidic applications, micro-cavities can be produced on an insert, which is then fitted in the main mold body. Generally speaking, in mold making technologies where different heights of the features or different qualities of surface finish are desired, the mold can be manufactured with inserts. While the main mold is typically made of steel, inserts can be manufactured of other materials, depending on the technology used.

As a result of the aforementioned inserts, height differences can occur due to tolerances, resulting in a transition line between the insert and the main body, which in turn can produce a height difference on the molded part. This insert transition is usually not preferred and is for microfluidic performance not desired. The insert transition can act as a fluidic stop for microfluidic devices.

In view of the above, a microfluidic feature at the insert transition or transition line is proposed which is independent of the height differences and does not act as a fluidic stop. This approach will in the following be explained with respect to the example of the cartridge described above, though it can similarly be applied in many other situations and for the manufacturing of other products, too.

Figure 6:
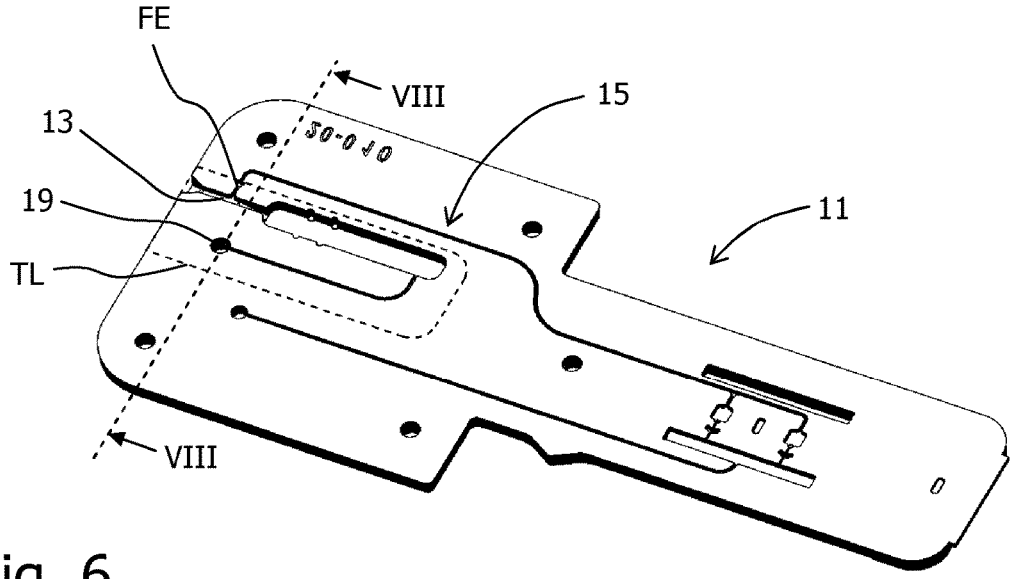
FIG. 6 shows in a top view onto an injection molded base part of a cartridge an indication of a transition line generated by injection molding.

FIG. 6 shows in a perspective top view a base part 11 of a cartridge 10 (as described above) as a particular example of a microfluidic device with several functions such as channels, reaction chambers, fluidic stops etc. The dashed line TL indicates a boundary of a separate insert within the injection mold used to produce the total device. The insert boundary in the mold results in a witness line on the product, wherein said line is in the following called "transition line" TL. This transition line TL can be elevated or depressed in the plastic depending on the mold-insert combination and tolerances of the mold and/or insert. As can been seen a microfluidic channel 15 is crossing this insert transition line TL, resulting in a transition of the channel due to alignment and alignment tolerances of both parts of the mold.

Figure 7:
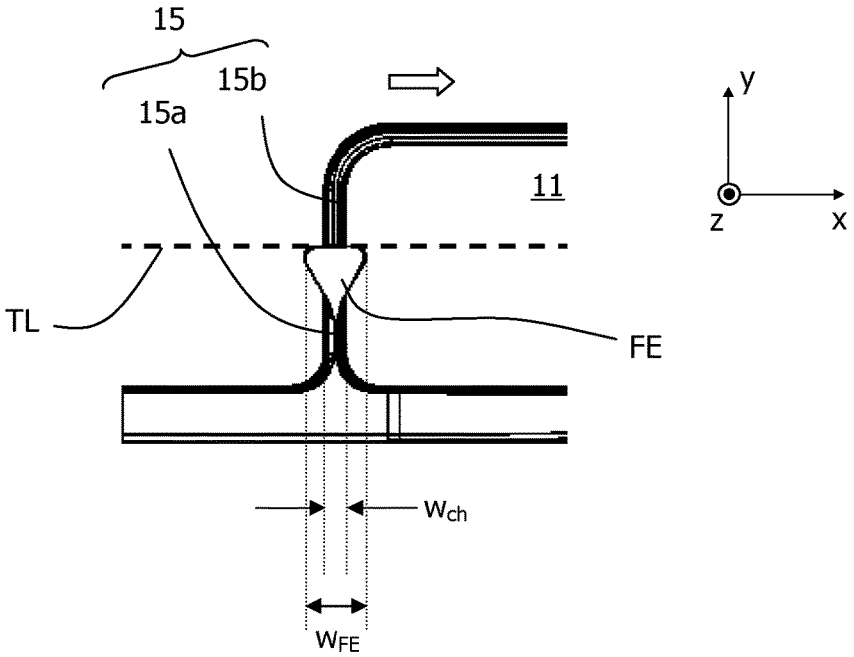
FIG. 7 shows an enlarged top view onto the fluidic element of the cartridge of FIG. 6.

FIG. 7 shows an enlarged top view of the area around the channel 15 at the transition line TL. The channel 15 comprises a first portion 15*a* that is located within the dashed area and hence produced by an insert during injection molding. At the transition line TL, this first portion 15*a* of the channel passes over to a second portion 15*b* of the channel 15. It can further be seen that a "fluidic element" FE is located at the end of the first channel portion 15*a*, said fluidic element having a triangular shape that corresponds to a continuous increase in cross section of the channel 15 in flow direction (block arrow) up to the transition line TL. In particular, the width of the fluidic element FE in x-direction increases in flow direction from the (nominal) width $w_{ch}$ of the first channel portion 15*a* to a width $w_{FE}$ at the transition line TL. A similar increase in dimensions of the fluidic element FE occurs in z-direction.

To put it differently, the fluidic element FE consists of a triangular shaped feature with dimensions at the interface (transition line) which are larger compared to the channel after the insert transition for the width and height of the transition. In a particular case the channel dimensions after the transition line TL may be about 200 μm in width and height. The channel depth and width $w_{ch}$ before the transition line TL may be about 250 μm and the width $w_{FE}$ at the transition about 550 μm.

A triangular shaped feature may be chosen as it minimizes the volume in the channels. However, this is not necessary for the function of the feature. The dimensions are such that the tolerances of the insert in the mold in all directions are less compared to the difference in dimensions before and after the transition. Other variations of this feature are possible, too.

The described fluidic element FE enables error-free autonomous flow across the insert boundary of micro fluidic devices with insert transitions. As shown in the example, the triangular shaped feature may be integrated in the micro fluidic path of the device.

Figure 8:
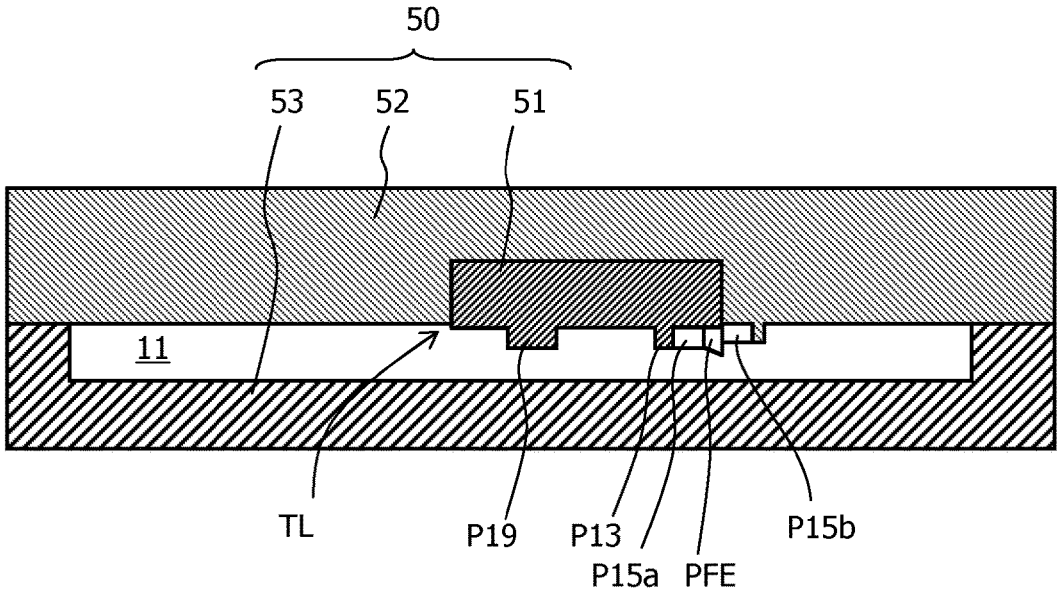
FIG. 8 shows an embodiment of an injection mold in a schematic cross section at a position corresponding to the dotted line VIII-VIII of FIG. 6.

FIG. 8 schematically shows an embodiment of an injection mold 50 in a cross section at a position corresponding to the dotted line VIII-VIII of FIG. 6 (sections through material are hatched, side views onto components not). It can be seen that the injection mold comprises:

A first mold body 51, which is in the following also called "insert" as it is accommodated in a second mold body 52. Due to component tolerances, there is a more or less pronounced deviation from an ideal, smooth transition between the first and the second mold bodies along the "transition line" TL where these bodies meet.

Said second mold body 52.

A third mold body 53.

The three mold bodies 51, 52, 53 together form a cavity in which a base part 11 of a cartridge can be formed by injection molding.

The insert 51 has several projections extending into the cavity that generate recesses in the produced cartridge. In particular, a projection P19 generates the vent port 19, a projection P13 generates the intake capillary channel 13, a projection P15*a* generates the first portion of the channel 15, a projection P15*b* generates the second portion of the channel 15. Moreover, the projection P15*a* is augmented by an additional projection PFE that generates the fluidic element FE in the final cartridge 10.

In summary, an approach has been described that is applicable in the situation of mold making technologies and especially in mold making technologies where different heights of the features are desired wherein the mold is manufactured with inserts. As a result of these inserts, height differences can occur. It is proposed to add a microfluidic feature at the insert transition which is independent of the height differences and does not act as a fluidic stop.

The invention is inter alia applicable in micro fluidic systems that have diverse and widespread applications. Some examples of systems and processes that may employ the described technology include DNA analysis (e.g., polymerase chain reaction and high-throughput sequencing), proteomics, inkjet printers, blood-cell-separation equipment, biochemical assays, chemical synthesis, genetic analysis, drug screening, electrochromatography, surface micromachining, laser ablation, and immediate point-of-care diagnosis of diseases.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A cartridge for processing a liquid sample, comprising:

an intake port for receiving the sample;

a processing chamber for processing the sample;

a storage chamber for intermediately storing the sample, the storage chamber having a storage capillary suction pressure;

an intake capillary channel that connects the intake port to the storage chamber, the intake capillary channel having an intake capillary suction pressure, the intake capillary suction pressure and the storage capillary suction pressure driving the sample from the intake port to the storage chamber through the intake capillary channel without additional pressure;

a feeding capillary channel that branches from the intake capillary channel and connects the storage chamber to the processing chamber, the feeding capillary channel and the processing chamber having a feeding capillary pressure, the feeding capillary suction pressure being lower than the storage capillary suction pressure, thereby driving the sample from the storage chamber, through a common portion of the intake capillary channel, to the processing chamber without additional pressure; and a flow control element that is externally controllable to draw the sample from the storage chamber towards the processing chamber without active pumping, wherein the common portion of the intake capillary channel passes the sample from the intake port to the storage chamber and from the storage chamber to the feeding capillary channel.

2. The cartridge according to claim 1, wherein the storage is configured such that the storage capillary suction pressure enables filling times of the storage chamber to be less than about 3 seconds, and filling times of the processing chamber to be lower than a predetermined time limit.

3. The cartridge according to claim 1, wherein the flow control element is controllable to prevent the sample from passing to the processing chamber when the sample enters into the intake ports, causing the sample entering the intake port to pass to the storage chamber.

4. The cartridge according to claim 1, wherein a shape of a cross section of the feeding capillary channel is different from a shape of a cross section of the intake capillary channel.

5. The cartridge according to claim 1, wherein the intake capillary channel is shorter than the storage chamber and/or the feeding capillary channel.

6. The cartridge according to claim 1, wherein the intake capillary channel is less than about 3 mm in length.

7. The cartridge according to claim 1, further comprising:

a cover that is at least partially transparent, enabling viewing of at least the storage chamber.

8. The cartridge according to claim 1, wherein the storage chamber comprises at least one set of pinning structures.

9. The cartridge according to claim 1, wherein the flow control element comprises a controllably openable vent that causes the sample to pass from the storage chamber to the processing chamber when opened.

10. The cartridge according to claim 1, wherein the processing chamber is configured to enable optical measurements.

11. An injection mold for manufacturing a cartridge according to claim 1, the injection mold comprising:

a first mold body and a second mold body to be put in contact to each other along a transition line for creating a cavity in which the cartridge is formed by injection molding, wherein:

the first mold body is provided with a first projection corresponding to a first portion of at least the feeding capillary channel of the cartridge;

the second mold body is provided with a second projection corresponding to a second portion of the feeding capillary channel;

the first and second projections contact each other at the transition line to join the first and second portions of the feeding capillary channel; and the first mold body and/or the second mold body comprises an additional projection for generating a fluidic element that compensates for a flow barrier imposed by the transition line.

12. A microfluidic device, obtained by injection molding with an injection mold according to claim 11.

13. The cartridge according to claim 1, wherein the feeding capillary channel crosses a transition line generated by different mold bodies of an injection mold used for manufacturing the cartridge, wherein the feeding capillary channel comprises a fluidic element that compensates for a flow barrier imposed by the transition line.

14. The cartridge according to claim 1, wherein the storage chamber is configured such that the storage capillary suction pressure enables filling times of the storage chamber to be less than about 5 seconds, and filling times of the processing chamber to be lower than a predetermined time limit.

15. The cartridge according to claim 1, wherein a length of the intake capillary channel is less than about 5 mm in length.

16. The cartridge according to claim 1, wherein the optical measurements, comprise FTIR measurements or scattered light measurements.

17. A method of processing a liquid sample in a cartridge comprising an intake port for receiving the sample, a storage chamber for intermediately storing the sample, a processing chamber for processing the sample, an intake capillary channel that connects the intake port to the storage chamber, a feeding capillary channel that branches from the intake capillary channel at a branching position and connects the storage B chamber to the processing chamber, and a flow control element that is externally controllable to draw the sample from the storage chamber towards the processing chamber without active pumping, the method comprising:

drawing the sample by first capillary forces into the storage chamber through the intake capillary while the flow control element is not actuated;

actuating the flow control element causing the sample to be forwarded by second capillary forces from the storage chamber to the processing chamber through a shared portion of the intake capillary, between the storage chamber and the branching position, and the feeding capillary channel, without additional pressure; and processing of the sample in the processing chamber.

18. The method according to claim 17, wherein a duration of drawing the sample into the storage chamber is less than a duration of forwarding the sample to the processing chamber.

19. The method according to claim 17, wherein the duration of drawing the sample into the storage chamber is less than about 3 seconds.

* * * * *